United States Patent [19]

Biance

[11] 4,403,432

[45] Sep. 13, 1983

[54] TRAILER HITCH SNOW PLOW

[76] Inventor: Michael P. Biance, 7 Martingale Dr., Albany, N.Y. 12205

[21] Appl. No.: 467,400

[22] Filed: Feb. 17, 1983

[51] Int. Cl.[3] ..... E01H 5/06; A01B 65/00

[52] U.S. Cl. ..... 37/235; 37/268; 172/445.2; 172/799.5

[58] Field of Search ..... 37/235, 268, 269, 283; 172/799.5, 445.2

[56] References Cited

U.S. PATENT DOCUMENTS

| | | | |
|---|---|---|---|
| 945,787 | 1/1910 | Krajeck | 37/268 |
| 1,020,727 | 3/1912 | Sutcliffe | 37/268 |
| 1,401,614 | 12/1921 | Larson | 37/268 |
| 1,704,016 | 3/1929 | Pils | 37/268 |
| 2,059,818 | 11/1936 | Simon | 37/268 |
| 2,333,361 | 11/1943 | Churchill | 37/268 |
| 2,723,472 | 11/1955 | Bartlett | 172/445.2 |
| 2,740,214 | 4/1956 | Collins | 172/445.2 |
| 2,749,631 | 6/1956 | Thompson | 37/268 |
| 2,815,591 | 12/1957 | Mattingly | 172/445.2 |
| 3,302,317 | 2/1967 | Domres | 37/268 |
| 3,598,186 | 8/1971 | Coontz | 172/445.2 |
| 3,755,930 | 9/1973 | Brandt et al. | 37/268 |
| 3,800,447 | 4/1974 | Harvey | 37/268 |
| 3,858,663 | 1/1975 | Lurwig, Jr. | 172/445.2 |
| 4,055,222 | 10/1977 | Runte | 172/799.5 |
| 4,369,590 | 1/1983 | Miller | 37/235 |

*Primary Examiner*—E. H. Eickholt

*Attorney, Agent, or Firm*—Walter F. Wessendorf, Jr.

[57] ABSTRACT

Disclosed is a snow plow carried on the rear of a vehicle with its plow blade disposable in positions of raised or lowered elevation, and disposable in positions of traverse. The snow plow is so carried by means of a receiver carrying a tongue fixed to a pedestal assembly to which is fixed a pintle which freely carries a rotatable sleeve to which is fixed a first rectangular tubing pivotally mounted with a second rectangular tubing to which the plow blade is affixed. A winch cable engaged with the second tubing raises and lowers the plow blade upon operation of the winch. A clevis pin is engageable with alignable sets of holes through the pintle and sleeve to lock the plow blade in discrete traverse positions.

6 Claims, 13 Drawing Figures

1
3
5
7
9
11
13
15
17
19
47
49
51
77

3
5
7
9
11
41
47
51

3
5
7
9
11
41
47
51

FIG. 4
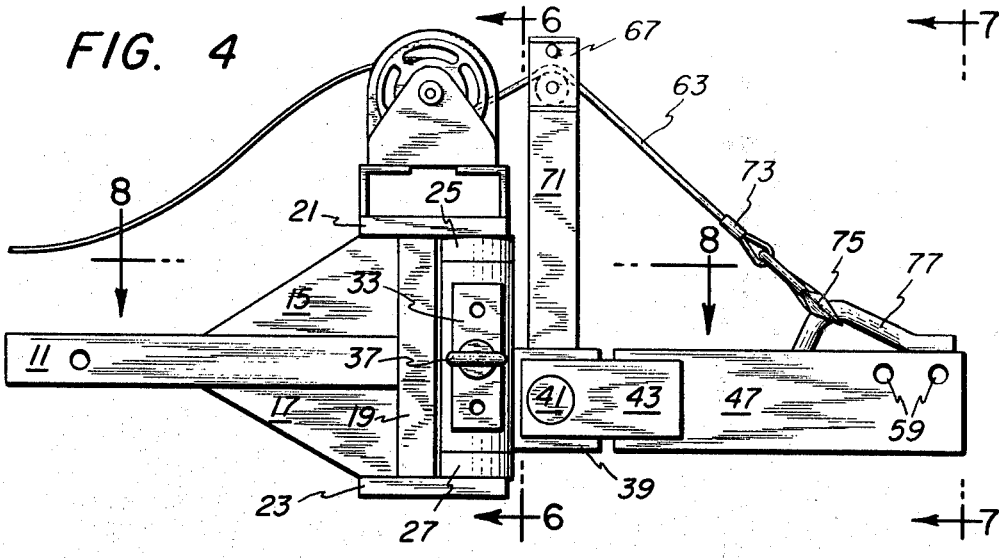
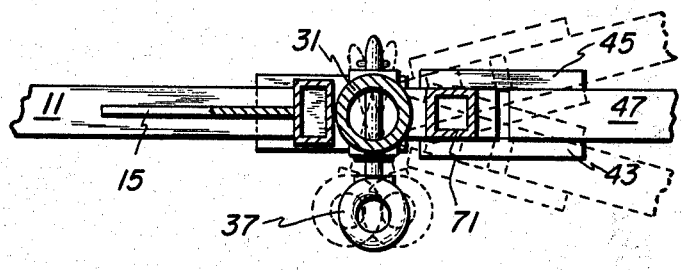
FIG. 8
FIG. 7
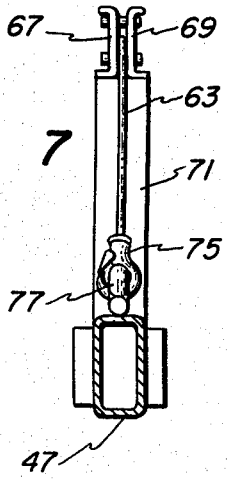
FIG. 6
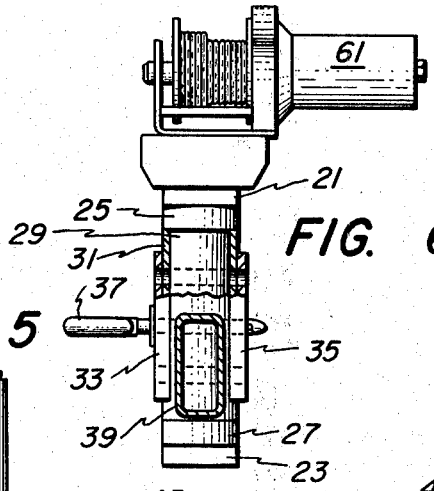
FIG. 5
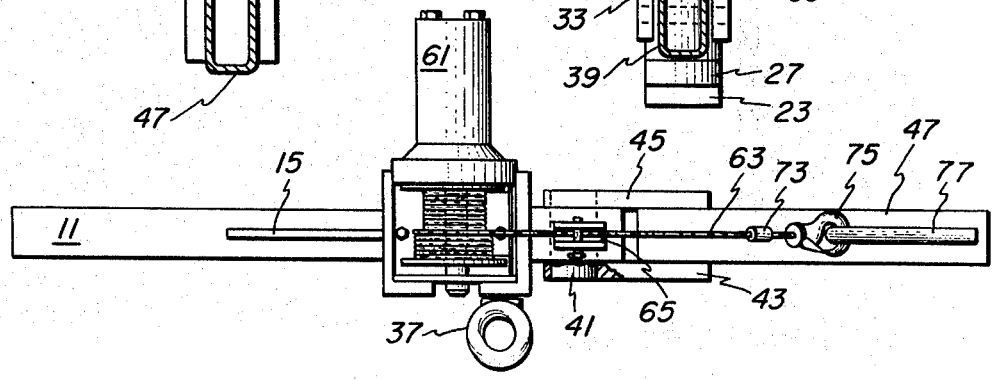

TRAILER HITCH SNOW PLOW

BACKGROUND OF THE INVENTION

1. Technical Field

This invention relates generally to snow plows, and more particularly to a snow plow that can be operatively carried on the rear of a vehicle and disposed in positions of plow blade elevation and fixed positions of traverse.

2. Background Art

The prior art, U.S. Pat. No. 945,787, discloses an ice field scraper; U.S. Pat. No. 1,020,727 discloses a snow plow; U.S. Pat. No. 1,401,614 discloses a road drag; U.S. Pat. No. 1,704,016 discloses a snow plow; U.S. Pat. No. 2,059,818 discloses scientific snow removal and self loading truck; U.S. Pat. No. 2,333,361 discloses a snow removing apparatus; U.S. Pat. No. 2,749,631 discloses a multiple, adjustable blade scraper; U.S. Pat. No. 3,755,930 discloses a snow grader; and U.S. Pat. No. 3,800,447 discloses a multiblade snowplow vehicle.

SUMMARY OF THE INVENTION

The object of the invention is to provide a snow plow that has a tongue for removably mounting such tongue within the receiver carried on the rear of a vehicle of the pickup truck type. The pickup truck vehicle has brackets carried by the vehicle's chassis, and such brackets carry and dispose outwardly such receiver. The snow plow has an electric winch operatively connected to a pivotally mounted plow blade and which is controllable to effect raising and lowering of the plow blade. Lowering of the plow blade is assisted by gravity action. The plow blade can be disposed, positioned and fixed in several discrete positions of traverse.

BRIEF DESCRIPTION OF THE DRAWINGS

This object and other objects of the invention should be discerned and appreciated by reference to the drawings, wherein like reference numerals refer to similar parts throughout the several views, in which:

FIG. 4 is an enlarged side elevation of the snow plow without the plow blade attached;

FIG. 5 is a top view of FIG. 4;

FIG. 6 is a front elevation of FIG. 4 in the direction of the arrows 6—6 in FIG. 4;

FIG. 7 is a front elevation of a portion of the invention between the arrows 6—6 and 7—7 in FIG. 4;

FIG. 8 is a partial view in cross section taken in the direction of the arrows 8—8 in FIG. 4;

DESCRIPTION OF THE PREFERRED EMBODIMENT

Figure 1:
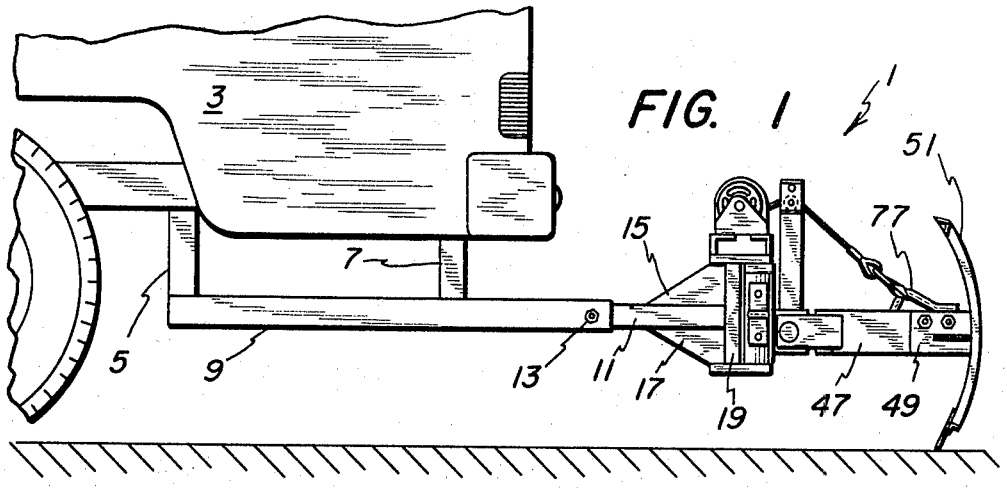
FIGS. 1–3 show the bottom rear segment of a vehicle incorporating a trailer-hitch receiver of the square-channel type into which is inserted the tongue, and which show the plow blade in its lowered operative position and in raised positions.

To facilitate the understanding of the invention, a nomenclature list is herewith provided:

1: generally refers to the trailer hitch snow plow
3: vehicle
5: bracket
7: bracket
9: receiver
11: tongue
13: cross pin
15: gusset
17: gusset
19: pedestal
21: top pedestal plate
23: bottom pedestal plate
25: intermediate top plate
27: intermediate bottom plate
29: pintle
31: sleeve
33: lateral plate
35: lateral plate
37: eye bolt clevis pin
39: rectangular tubing
41: cross pin
43: lateral arm
45: lateral arm
47: rectangular tubing
49: U-shaped bracket
51: plow blade
53: gusset
55: gusset
57: bolt
71: electric winch
63: cable
65: roller
67: bracket
69: bracket
71: pedestal
73: eye fitting
75: snap hook
77: L-shaped hook rod In FIG. 1 of the drawings, reference numeral 1 generally refers to the trailer hitch snow plow invention removably mounted on the rear end of a vehicle. The snow plow is made of steel or other suitable material.

Vehicle 3 has brackets 5 and 7, fixed to and depending from the vehicle's chassis, which fixedly dispose rearwardly and outwardly a receiver 9. Receiver 9 removably receives the tongue 11 of snow plow 1. A cross pin 13, disposed through aligned transverse holes in the receiver 9 and tongue 11, removably receives tongue 11.

Gussets 15 and 17, welded or otherwise suitably affixed, secure gussets 15 and 17 to tongue 11, pedestal 19, and the top and bottom pedestal plates 21 and 23. Fixed to and depending from the top pedestal plate 21 is intermediate top plate 25, and fixed to and upstanding from bottom pedestal plate 23 is intermediate bottom plate 27.

Figure 9:
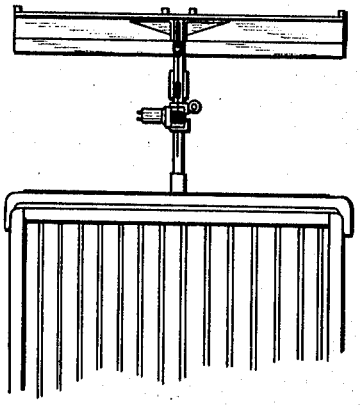
FIGS. 9–11 are top views of the rear segment of the vehicle to which the snow plow is attached and show three fixed positions of traverse of the plow blade.
Figure 13:
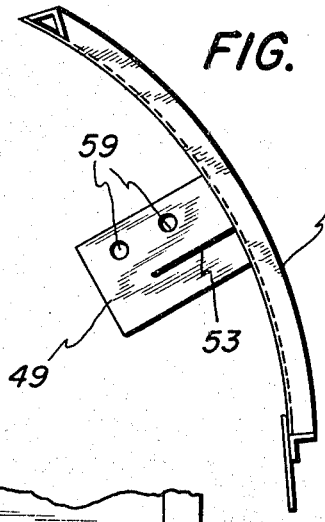
FIG. 13 is a side view of the plow blade.

Intermediate top and bottom plates 25 and 27 fixedly mount in vertical disposition a pintle 29 which freely mounts in rotary relationships a sleeve 31. Lateral plates 33 and 35 are welded or otherwise suitably fixed to sleeve 31. An eye bolt clevis pin 37 removably disposed through one of three sets of aligned holes in lateral plates 33 and 35, sleeve 31 and pintle 29, permits the traverse of the snow plow to be adjustably fixed in one of the three positions indicated in FIG. 8 and shown more discernably in FIGS. 9, 10, and 11.

Rectangular tubing 39, welded or otherwise suitably fixed to sleeve 31, has a cross pin 41 which pivotally mounts lateral arms 43 and 45, welded to or otherwise suitably fixed to an elongated rectangular tubing 47.

A U-shaped bracket 49 is welded or otherwise suitably fixed to snow plow blade 51. Gussets 53 and 55, welded or otherwise suitably fixed to U-shaped bracket 49 and plow blade 51, provide additional support for bracket 49.

Bolts 57, disposed through and retentively engaged with aligned holes in U-shaped bracket 49 and holes 59 in elongated rectangular tubing 47, removably affix plow blade 51 on rectangular tubing 47.

An electric winch 61 mounted on top pedestal plate 21 has its cable 63 trained over a roller 65 freely mounted between brackets 67 and 69 welded to or otherwise suitably fixed to a pedestal 71 welded to or otherwise suitably fixed to rectangular tubing 39.

Cable 63 terminates in fixed relationship with an eye fitting 73 that carries a snap hook 75 operatively engaged with an L-shaped hook rod 77 welded to or otherwise fixed to elongated rectangular tubing 47.

Figure 2:
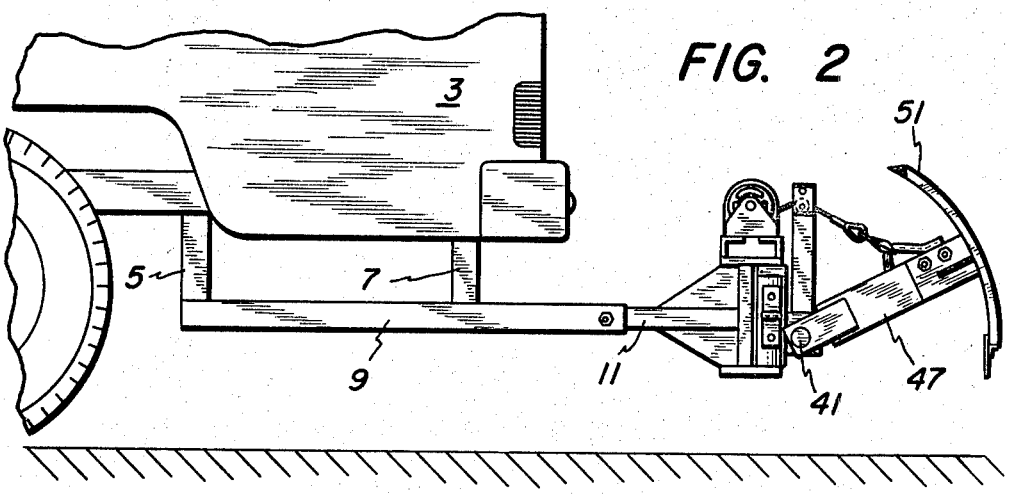
Figure 3:
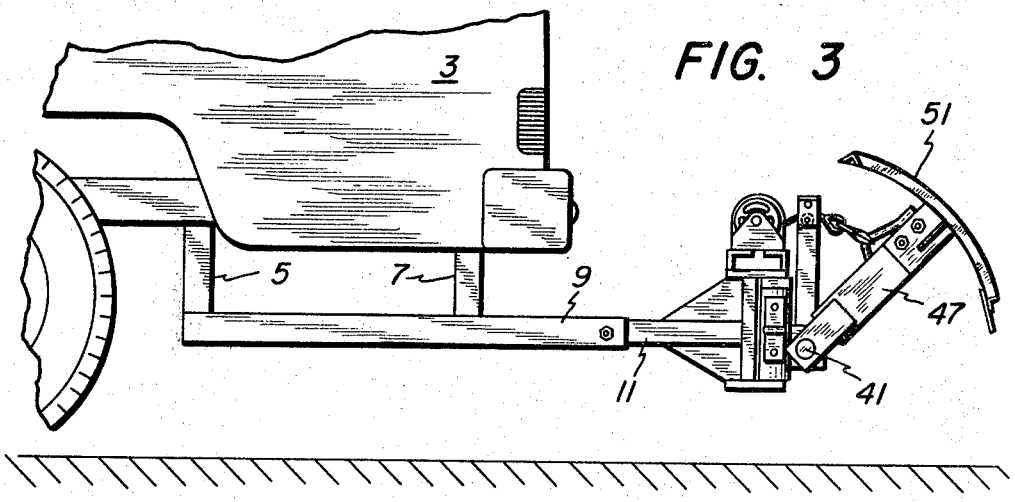

In operation of the snow plow with the tongue 11 inserted in receiver 9, the driver traverses the plow blade 51 to the right or to the left and locks plow blade 51 in such traversed position by disposing eye bolt clevis pin 37 in engaged retentive relationship in the appropriate one of the sets of aligned holes in lateral plates 33 and 35, sleeve 31 and pintle 29. Then the driver appropriately operates a dashboard mounted control switch for the electric winch 61 to raise the plow blade 51 to an elevated position approximating those shown in FIGS. 2 and 3.

Figure 10:
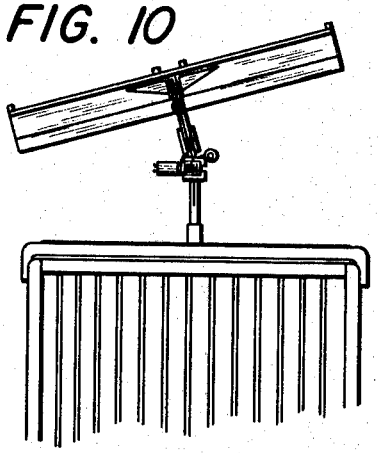
Figure 12:
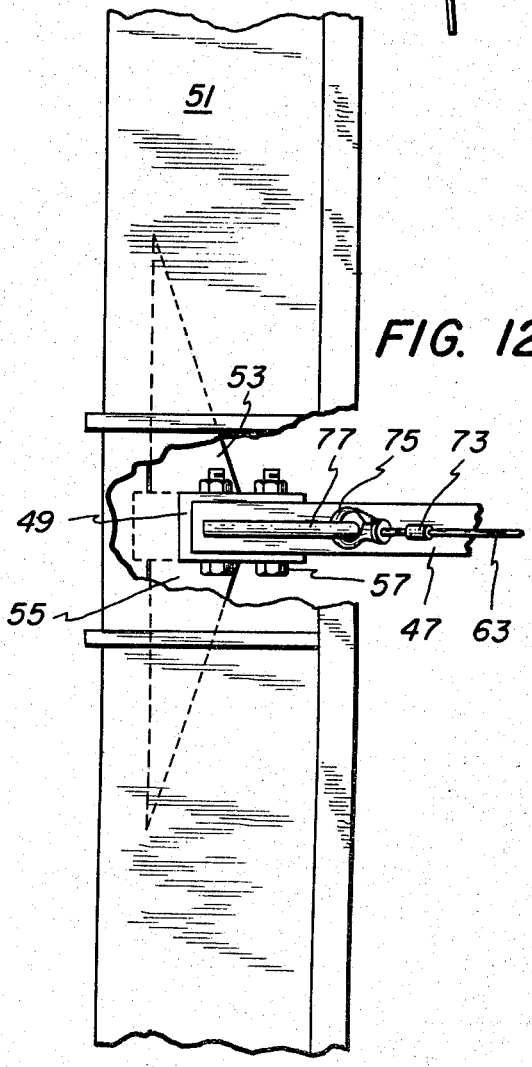
FIG. 12 is a partial top view of the plow blade.
Figure 11:
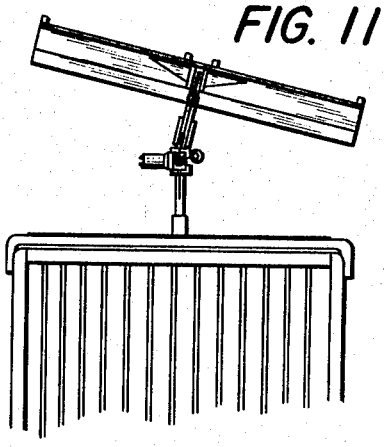

If the snow to be plowed from a driveway, for example, is light, the driver then simply backs his vehicle 3 to the rear of such driveway and appropriately operates electric winch 61 to lower, assisted by gravity action, the plow blade 51 to the position shown in FIG. 1. Then he drives his vehicle forward to have plow blade 51 engage the snow in a plowing path or swath the width of the plow blade 51. If the plow blade 51 is angled to the left and fixed in such position of traverse, as shown in FIG. 10, the snow will be moved and pushed laterally to the left upon forward movement of vehicle 3.

If the snowfall is heavy, the driver will back his vehicle 3 to the rear of such driveway, lower plow blade 51 only enough for the plow blade 51 to make a partial vertical cut in the snow to a certain workable height and drive vehicle 3 forward to move and push the snow laterally to the left or right depending upon the fixed traversed blade position. Depending upon the driveway width, the driver would repeat this operation in side-by-side or even overlapping plowing paths or swaths sufficient to clear the driveway of snow to a certain workable height. After this has been accomplished, the driver would back his vehicle to the rear of the driveway and lower his plow blade 51 all the way to the position shown in FIG. 1 and then drive his vehicle forward. Such operation would be repeated until the driveway has been cleared of snow.

This invention provides advantages over a snow plow mounted in the front of a vehicle. Cost-wise, the trailer hitch snow plow of this invention is considerably less than a front mounted and controlled snow plow.

With respect to a front-mounted snow plow, in the course of plowing the plowed snow blows back or is blown back covering the front windshield with snow and obstructing the driver's vision. Oftentimes, the vehicle's windshield wipers and front defroster are overwhelmed by the quantity of plowed snow on the windshield and are not capable of handling the shear quantity of such snow and such quantity sometimes ices over the windshield further exacerbating the problem of the vision-obstructed front windshield. With this invention with its rear-mounted plow, there is no impairment of vision. This feature is especially important from a safety point of view when other vehicles are operating on the street on which the driveway is being plowed, when such driveway mouths into a street with high snow banks from accumulated past snowfalls and when children are in the area.

After use, the snow plow of this invention can be easily and simply removed from vehicle 3 by removing cross pin 13 and effecting removal of tongue 11 from receiver 9. Plow blade 51 can be easily and simply removed by removing snap hook 75 from hook rod 77, and disconnecting bolts 57 from U-shaped bracket 49.

Reassembly is just as easy, simple and fast as disassembly.

Having thusly described my invention, I claim:

1. A snow plow operatively carried on and upon the rear of a vehicle and with its plow blade disposed in positions of raised or lowered elevation, and traverse, relative to said vehicle; said snow plow comprising a tongue, pedestal assembly, pintle, sleeve, pin, first member, second member, winch means and plow blade; said vehicle having on its bottom rear segment a receiver, said receiver operatively carrying said tongue and removably mounting said tongue, said tongue carrying said pedestal assembly, said pedestal assembly carrying said pintle, said pintle freely carrying said sleeve in rotary relationship and affording such traverse of said plow blade, said sleeve carrying said first member, said first member being in pivotal relationship with said second member and affording such elevation of said plow blade, said second member carrying said plow blade, said winch means being operatively connected to said second member to raise or lower said plow blade to a discrete position of elevation, said pintle and sleeve having sets of aligned holes with each set of which corresponding to a discrete position of traverse of said plow blade, and said pin being removably engaged with a set of said aligned holes in said pintle and sleeve to lock said plow blade in a discrete position of traverse.

2. A snow plow in accordance with claim 1, wherein said first member has a cross pin, wherein said second member fixedly carried lateral arms, wherein said cross pin of said first member pivotally mounts said lateral arms of said second member to provide such pivotal relationship of said first member with said second member.

3. A snow plow in accordance with claim 2, wherein said first member comprises tubing and wherein said second member comprises elongated tubing.

4. A snow plow in accordance with claim 1, wherein said winch means comprises a winch and cable, wherein said pedestal assembly mounts said winch, and wherein said winch cable is operatively connected to said second member to raise or lower said plow blade.

5. A snow plow in accordance with claim 2, wherein said snow plow has a pin, wherein said pintle and sleeve have sets of aligned holes each set of which corresponds to a discrete traverse position of said plow blade, and wherein said pin is removably engageable with said sets of aligned holes to lock same in discrete traverse positions.

6. A snow plow in accordance with claim 3, wherein said first member being in pivotal relationship with said second mamber comprises a cross pin of said first member pivotally mounting lateral arms fixed to said second member.

* * * * *